US011419441B2

(12) United States Patent
Waldeier

(10) Patent No.: US 11,419,441 B2
(45) Date of Patent: Aug. 23, 2022

(54) WEARABLE, PACKABLE NECK PILLOW FOR TRAVEL COMFORT AND STORAGE

(71) Applicant: Amber M. Waldeier, Liberty, MO (US)

(72) Inventor: Amber M. Waldeier, Liberty, MO (US)

( * ) Notice: Subject to any disclaimer, the term of this patent is extended or adjusted under 35 U.S.C. 154(b) by 37 days.

(21) Appl. No.: 17/060,845

(22) Filed: Oct. 1, 2020

(65) Prior Publication Data

US 2021/0100382 A1 Apr. 8, 2021

Related U.S. Application Data

(60) Provisional application No. 62/909,976, filed on Oct. 3, 2019.

(51) Int. Cl.

| | |
|---|---|
| ***A47G 9/10*** | (2006.01) |
| ***A47G 9/04*** | (2006.01) |
| ***A47C 16/00*** | (2006.01) |
| ***A47G 9/02*** | (2006.01) |

(52) U.S. Cl.

CPC ..... *A47G 9/1081* (2013.01); *A47C 16/00* (2013.01); *A47G 9/0253* (2013.01); *A47G 9/04* (2013.01); *A47G 9/1045* (2013.01)

(58) Field of Classification Search

CPC ..... A47G 9/1081; A47G 9/0253; A47G 9/04; A47G 9/1045; A47C 16/00

See application file for complete search history.

(56) References Cited

U.S. PATENT DOCUMENTS

| | | | | |
|---|---|---|---|---|
| 3,011,173 | A | 12/1961 | Goetz | |
| D302,775 | S | 8/1989 | Sinoff et al. | |
| 5,645,080 | A * | 7/1997 | Toso | A61F 5/028 602/19 |
| 5,918,332 | A | 7/1999 | Dees | |
| 6,206,223 | B1 | 3/2001 | Wicker | |
| 6,397,403 | B1 | 6/2002 | Waldman | |
| D522,300 | S | 6/2006 | Roberts | |
| 10,021,949 | B2 * | 7/2018 | Cooper | A45F 3/14 |
| 10,178,915 | B1 * | 1/2019 | Sternlight | A47C 7/383 |
| 10,292,508 | B1 * | 5/2019 | Kim | A47G 9/1081 |
| 10,426,242 | B1 * | 10/2019 | Little | A45F 3/005 |
| 10,863,826 | B1 * | 12/2020 | Schneider | A47G 9/1081 |
| 10,918,229 | B1 * | 2/2021 | Mello | A47G 9/04 |
| 2002/0014436 | A1 * | 2/2002 | Matthews Brown | A47D 13/083 206/770 |
| 2003/0116465 | A1 * | 6/2003 | Wilson, II | A45C 3/00 206/522 |

(Continued)

*Primary Examiner* — David R Hare
*Assistant Examiner* — George Sun
(74) *Attorney, Agent, or Firm* — Law Office of Mark Brown, LLC; Mark E. Brown

(57) ABSTRACT

A wearable and packable neck pillow includes first and second bolsters connected at their upper ends by a crosspiece. The crosspiece includes an opening to an interior of the neck pillow. The opening selectively closable by a closure, which can comprise a zipper, a snap fastener, a button and a hook-and-loop fastener. A bolster fastener is provided for attaching the bolsters at their lower ends, whereby the neck pillow is secured on a wearer. The neck pillow can include additional compartments, such as pockets on one or both of the bolsters. Printing can be placed on the neck pillow.

4 Claims, 2 Drawing Sheets

(56) References Cited

U.S. PATENT DOCUMENTS

| | | | | |
|---|---|---|---|---|
| 2007/0192961 | A1* | 8/2007 | Tidwell | A47D 13/083 5/655 |
| 2007/0271703 | A1* | 11/2007 | Matthews Brown | A47D 13/08 5/636 |
| 2012/0036642 | A1* | 2/2012 | Brogan | A47G 9/1081 5/644 |
| 2012/0289116 | A1* | 11/2012 | Beuerle | A47G 9/0253 446/72 |
| 2014/0000036 | A1* | 1/2014 | Cohen | A47C 27/081 5/639 |
| 2018/0132621 | A1* | 5/2018 | Scrimshaw | A47C 16/00 |
| 2018/0146807 | A1* | 5/2018 | Silver | A47G 9/1045 |
| 2018/0310731 | A1* | 11/2018 | Staton | A47G 9/0253 |
| 2020/0178709 | A1* | 6/2020 | Brown | G09F 23/06 |

* cited by examiner

WEARABLE, PACKABLE NECK PILLOW FOR TRAVEL COMFORT AND STORAGE

CROSS-REFERENCE TO RELATED APPLICATION

This application claims priority in U.S. Provisional Patent Application No. 62/909,976, filed Oct. 3, 2019, which is incorporated herein by reference.

BACKGROUND OF THE INVENTION

1. Field of the Invention

The present invention relates generally to personal comfort and storage, and in particular to a wearable, packable neck pillow.

2. Description of the Related Art

Pillows are important personal accessories for facilitating restful sleep. Moreover, proper neck support and alignment tend to minimize discomfort, which can result from head-neck-body misalignment. Various sizes and shapes are available, including horseshoe-shaped neck pillows with pairs of bolsters connected by crosspieces. In use, the crosspieces are placed behind users' heads. Users' heads are cradled between the bolsters, which can extend to approximately shoulder level.

Such neck pillows are particularly popular with travelers who utilize travel time for resting and sleeping. For example, many airline passengers take advantage of extended flights for in-flight naps, with the objective of arriving at their destinations well-rested. Automobile, bus and train passengers also use travel time for sleeping. Neck pillows have the advantage of maintaining head-neck-body alignment while confining passengers within their personal spaces. Such passenger personal spaces are determined by the vehicle seating configurations. However, sleeping passengers in crowded passenger cabins, e.g., on fully-booked flights, often annoy other passengers by rolling or slumping into them. Neck pillows can reduce such negative personal interactions by maintaining their wearers in their own personal seat spaces. Entire rows of passengers can thus restfully slumber without contacting and annoying each other.

Another challenge facing travelers relates to stowing their personal items. Many individuals prefer to retain certain possessions in close proximity. Additional clothing items can assist with personal comfort, such as putting on a garment for additional warmth. Clothing items tend to be relatively soft and provide a comforting, cushioning, pillow-like effect. Valuable items such as wallets, purses and handbags may be retained in close proximity for security and convenience. Still further, personal identification, including drivers' licenses and passports, may be required at different travel phases, such as boarding aircraft and entering countries through various international customs stations. Many travelers also prefer to keep their personal care items and medications close-at-hand.

Previously there has not been available a wearable, packable neck pillow with the advantages and features of the present invention.

SUMMARY OF THE INVENTION

A wearable, packable neck pillow includes a pair of side bolsters connected by a crosspiece. A zipper is installed at the top of the crosspiece for providing access to the interior of the neck pillow. Personal items, such as articles of clothing, can be placed in the pillow for secure storage and additional cushioning effect. The bolsters can include pockets for receiving additional personal items, such as boarding passes and documents. The bolsters can be secured in place on a user by connecting fasteners located at their respective lower ends.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
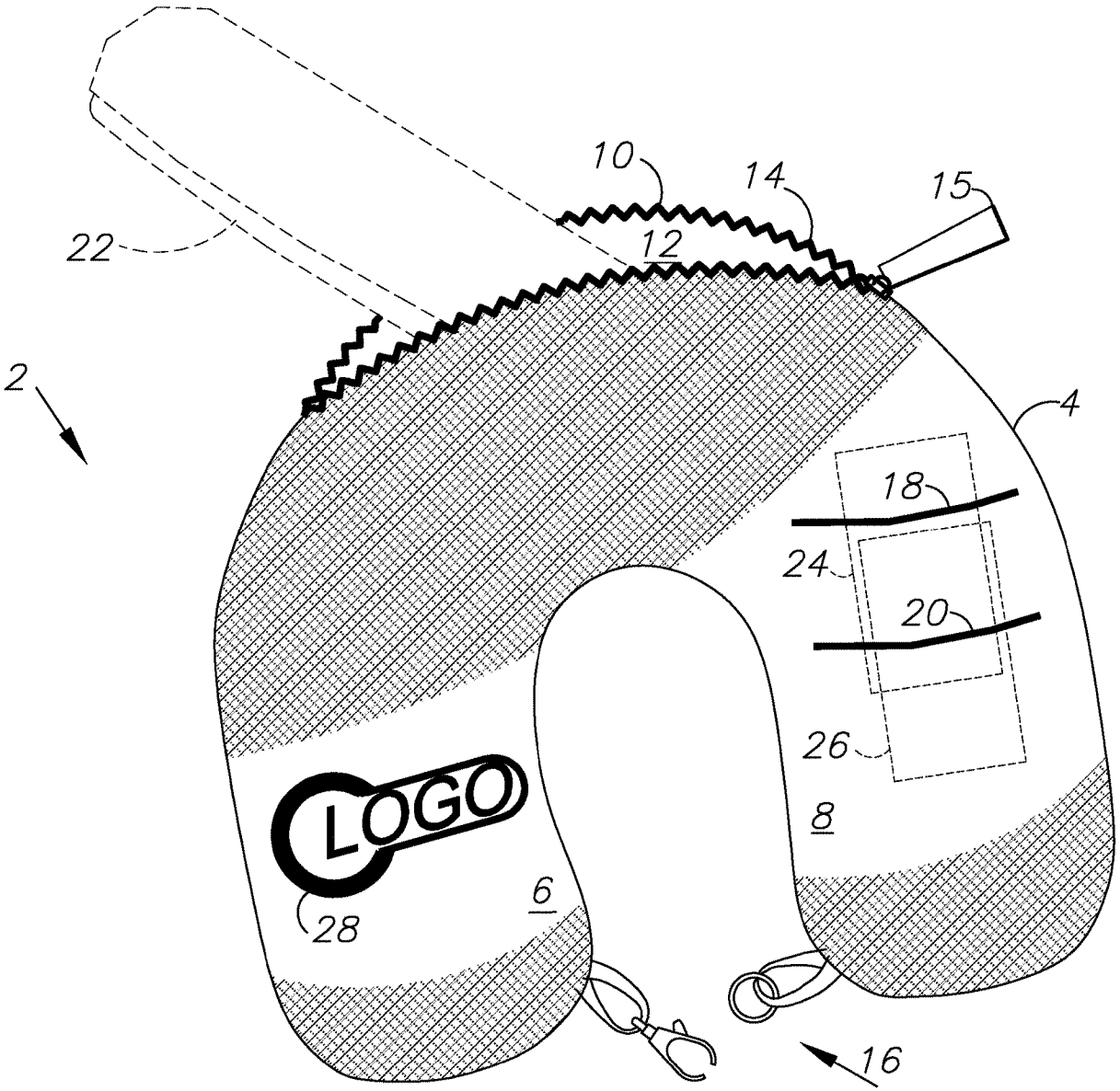
FIG. 1 is a perspective view of a wearable, packable neck pillow embodying an aspect of the present invention, shown with items being placed in an interior compartment and side pockets.
Figure 2:
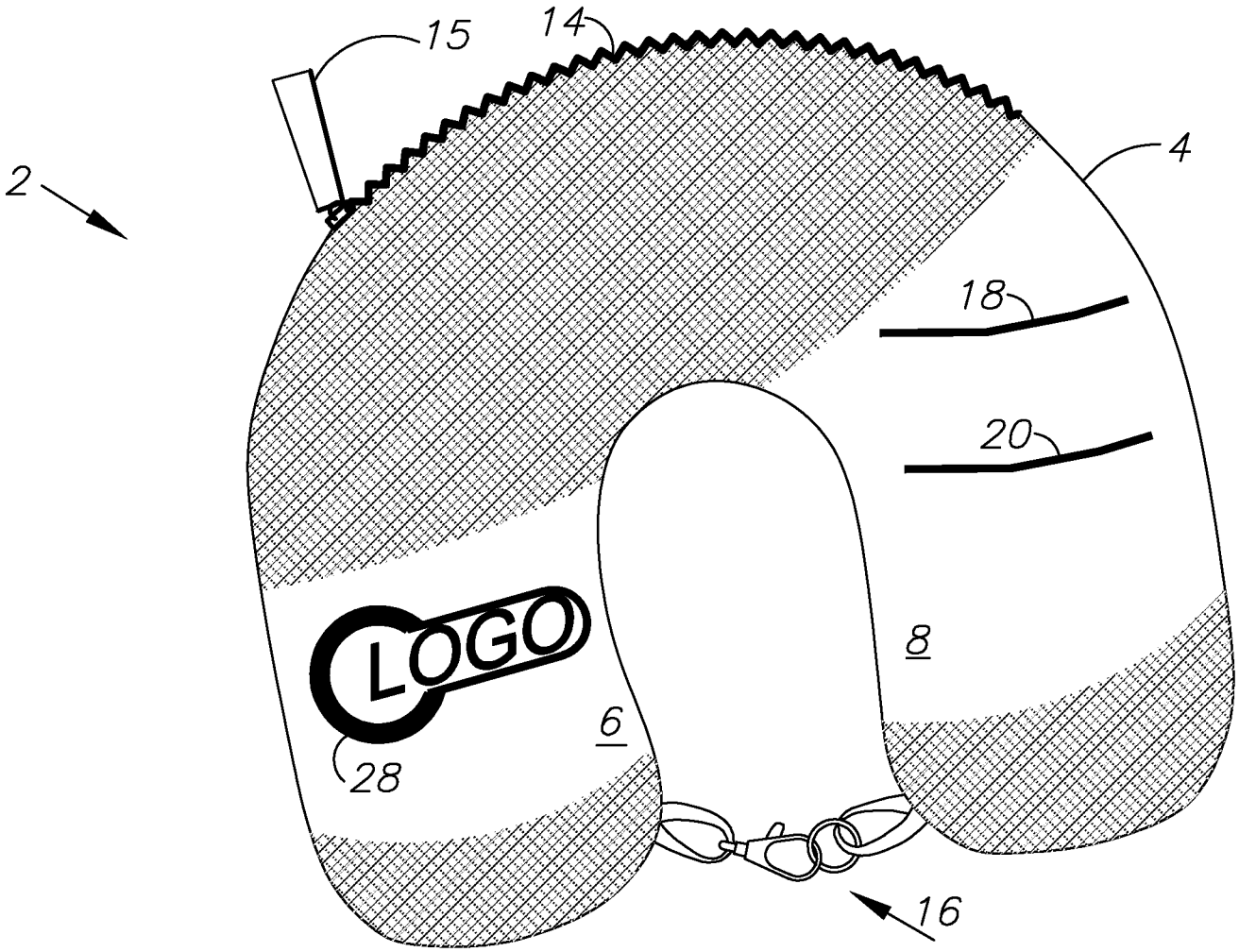
FIG. 2 is another perspective view of the neck pillow, shown with the interior compartment zipped shut in its closed configuration.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Said terminology will include the words specifically mentioned, derivatives thereof and words of similar meaning.

II. Wearable and Packable Neck Pillow 2

Referring to the drawings more detail, the reference numeral 2 generally designates a wearable and packable neck pillow embodying an aspect of the present invention and including a cover 4 comprising fabric or a similar flexible material. The neck pillow 2 includes a pair of bolsters 6, 8 which are joined at their tops by a crosspiece 10 including a zipper 14 providing access to an interior compartment 12. The zipper 14 is selectively opened and closed by a zipper tab 15. In addition to the main storage compartment 12, additional storage is provided by pockets 18, 20, which are shown on the bolster 8. The neck pillow 2 can include additional compartments, such as pockets, which can be placed at various locations and can comprise various configurations. The compartments can be enclosed by various fasteners, such as zippers, snaps, buttons, hook-and-loop (e.g., Velcro® fasteners), etc. The bolsters 6, 8 can be selectively connected at their lower ends by suitable fasteners, such as eyelet fasteners 16 as shown. Alternatively, other bolster fasteners can be utilized, such as snaps, buttons, magnets, clips, buckles, bayonet-type fasteners, hook-and-loop (e.g., Velcro® fasteners), etc.

III. Operation

In use, the main interior compartment 12 can receive various items. Clothing and other soft, flexible items enhance the functionality and comfort as a pillow. For example: a traveler can strategically place articles of clothing 22 in the crosspiece 10 for a comfortable cushion behind his or her head; and the pockets 18, 20 can receive items that the traveler prefers having close-at-hand for convenience and accessibility, such as wallets, currency, identification, etc. For international air travelers, the pockets 18, 20 can provide convenient, readily-accessible storage for boarding passes 24, passports 26 and other items.

The neck pillow 2 can be fabricated from various flexible materials, such as nylon for strength and flexibility. The surface areas can be printed with decorative content, commercial messages and advertising, e.g. a logo 28. The neck pillow can be personalized, e.g., with the name of its owner. Moreover, the surface areas of the neck pillow 2 provide high-visibility areas for promoting travel services, destinations, etc.

IV. Conclusion

It is to be understood that the invention can be embodied in various forms and is not to be limited to the examples specifically discussed above. The range of components and configurations which can be utilized in the practice of the present invention is virtually unlimited.

The invention claimed is:

1. A wearable, packable neck pillow comprising:

first and second bolsters each having upper and lower ends;

a crosspiece connected to and extending between said bolster upper ends;

said crosspiece and said bolsters enclosing an interior compartment;

an opening to said interior compartment;

an opening closure configured for an open position providing access to said interior compartment through said opening and a closed position closing said opening to said interior compartment;

said opening closure comprising one of a zipper, a snap fastener, a button and a hook-and-loop fastener;

a bolster fastener connected to and interconnecting said bolsters;

said bolster fastener comprises: first and second fabric loops attached to said first and second bolsters respectively at their lower ends and extending inwardly into a neck opening partially enclosed by said bolsters and said crosspiece; a clasp with open and closed configurations and a thumb release configured for opening said clasp to its open configuration; said clasp mounted on one of said fabric loops; a ring-shaped eyelet mounted on the other of said bolster lower ends; said eyelet receiving and coupling with said clasp whereby said bolster lower ends are secured together with said clasp in its closed configuration, coupled with said eyelet; and a multi-compartment pocket comprising at least two pocket compartments formed in one of said bolsters, said pocket compartments overlying each other and configured for exposing the tops of objects placed therein to a front of said neck pillow.

2. The neck pillow according to claim 1, which comprises a synthetic fabric material.

3. The neck pillow according to claim 1, which includes printing on an externally-visible portion of said neck pillow.

4. The neck pillow according to claim 3 wherein said printing comprises a commercial message.

* * * * *